US006843735B2

(12) United States Patent
Sajima et al.

(10) Patent No.: US 6,843,735 B2
(45) Date of Patent: Jan. 18, 2005

(54) GOLF BALL

(75) Inventors: Takahiro Sajima, Kobe (JP); Keiji Ohama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/360,656

(22) Filed: Feb. 10, 2003

(65) Prior Publication Data

US 2003/0162609 A1 Aug. 28, 2003

(30) Foreign Application Priority Data

Feb. 27, 2002 (JP) ..... 2002-050895

(51) Int. Cl.[7] ..... A63B 37/12
(52) U.S. Cl. ..... 473/383
(58) Field of Search ..... 473/378–384

(56) References Cited

U.S. PATENT DOCUMENTS 5,967,908 A 10/1999 Yamagishi et al.
6,210,292 B1 4/2001 Higuchi et al.
6,336,873 B1 1/2002 Yamagishi et al.

FOREIGN PATENT DOCUMENTS

EP 0 897 732 A2 2/1999

*Primary Examiner*—Raeann Gorden
(74) *Attorney, Agent, or Firm*—Birch, Stewart, Kolasch & Birch, LLP

(57) ABSTRACT

A golf ball which includes a core, a cover having Shore D hardness of equal to or greater than 58, and numerous dimples formed on the surface of said cover, wherein a proportion R1 of number of dimples having a ratio (B/T), which is a ratio of a height B of a bottom of the dimple to a nominal thickness T of the cover, of equal to or less than 0.80 occupied in total number of the dimples is equal to or greater than 10%.

4 Claims, 4 Drawing Sheets

GOLF BALL

This nonprovisional application claims priority under 35 U.S.C. § 119(a) on patent application Ser. No. 2002-050895 filed in JAPAN on Feb. 27, 2002 which is herein incorporated by reference.

BACKGROUND OF THE INVENTION

1. Field of the Invention

The present invention relates to golf balls. More particularly, the present invention relates to golf balls containing a core and a cover, with dimples being formed on the cover.

2. Description of the Related Art

General golf balls other than those manufactured for use in practice ranges comprise a core and a cover. There exist cores composed of a single solid rubber layer, two or more solid rubber layers, a synthetic resin layer in addition to a solid rubber layer, and the like. The cover requires excellent durability because it is the part the golf ball which contacts with a golf club upon impact and which contacts with the ground surface upon being dropped. To achieve durability, a synthetic resin is often used for the cover.

Conventionally, hardness of a cover has been investigated from various aspects. In general, by making the cover harder, the resilience performance of a golf ball is apt to be improved. To the contrary, by making the cover softer, the feel at impact of the golf ball is apt to be improved. In other words, a golf ball having a hard cover has the defect of an inferior feel at impact, while a golf ball having a soft cover has the defect of an inferior resilience performance.

Thickness of a cover has been also investigated from various aspects. In general, by making the cover thicker, a resilience performance of a golf ball is apt to be improved. To the contrary, by making the cover thinner, feel at impact of the golf ball is apt to be improved. In other words, a golf ball having a thick cover has the defect of an inferior feel at impact, while a golf ball having a thin cover has the defect of an inferior resilience performance. The resilience performance and feel at impact are reciprocal performances.

A golf ball has from about 200 to 550 dimples on its surface. The role of the dimples involves causing turbulent flow detachment by promoting turbulent flow transition of a boundary layer by disrupting the air flow around the golf ball during flight. By promoting turbulent flow transition, the detachment point of air from the golf ball shifts backwards leading to a reduction in the drag coefficient (Cd) so that the flight distance of the golf ball is extended. In addition, the difference in detachment points on the upper and lower sides of the golf ball resulting from back spin is increased by the promotion of turbulent flow transition, whereby the lifting force that acts on the golf ball is elevated.

Specifications of the cover exert an influence upon the behavior of a golf ball and a golf club at impact. To the contrary, specifications of the dimples exert an influence upon the aerodynamic characteristics after impact. Specifications of the cover and specifications of the dimples are considered by the skilled person in this art as discrete factors in terms of performances of a golf ball.

In Japanese Patent Publication Reference JP-A-305114/1998, JP-A-57067/1999, JP-A-225209/2000 and JP-A-70414/2000, there are disclosed golf balls having combination of an optimized cover and optimized dimples.

Even with the techniques disclosed in these publications, specifications of the dimples have been merely comprehended as a factor that exerts an influence upon aerodynamic characteristics. Specifications of the dimples have not been necessarily considered as a factor that exerts an influence upon the behavior of a golf ball after impact. With respect to the behavior of a golf ball at impact, there remains room for improvement. Golfers have always desired to use golf balls that are excellent in terms of both a resilience performance and feel, at impact.

SUMMARY OF THE INVENTION

The golf ball according to the present invention comprises a core, a cover and numerous dimples formed on the surface of the cover. Shore D hardness of the cover is equal to or greater than 58. The proportion R1 of the number of dimples having a ratio (B/T), which is a ratio of the height B of the bottom of the dimples to the nominal thickness T the cover, of equal to or less than 0.80 to the total number of the dimples, is equal to or greater than 10%.

In the cover of the golf ball, there coexist both sites with the ratio (B/T) being equal to or less than 0.80 and sites with no dimples present. The sites with the ratio (B/T) equal to or less than 0.80 are responsible for the improvement in feel at impact whereas the sites with no dimples present are responsible for the improvement in the resilience performance. In accordance with the golf ball of the present invention, the resilience performance and the feel at impact are both accomplished, concurrently.

Preferably, a proportion R2 of number of dimples having a ratio (B/T) of less than 0.40 present in the total number of dimples is equal to or less than 10%. This golf ball is also excellent in durability.

Preferably, a mean value of the ratio (BIT) for all the dimples is equal to or less than 0.86. In accordance with the golf ball of the present invention, a high resilience performance and an excellent feel at impact are both accomplished, concurrently.

The present invention exerts a marked effect when the golf ball comprises a core composed of a center and a mid layer, and the difference between the Shore D hardness Hm of the mid layer and Shore D hardness Hc of the cover (Hc-Hm) is equal to or greater than 3. In particular, the present invention exerts a marked effect when the golf ball comprises a mid layer having Shore D hardness of equal to or less than 60.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

The present invention is hereinafter described in detail with appropriate references to the accompanying drawings according to the preferred embodiments of the present invention.

Figure 1:
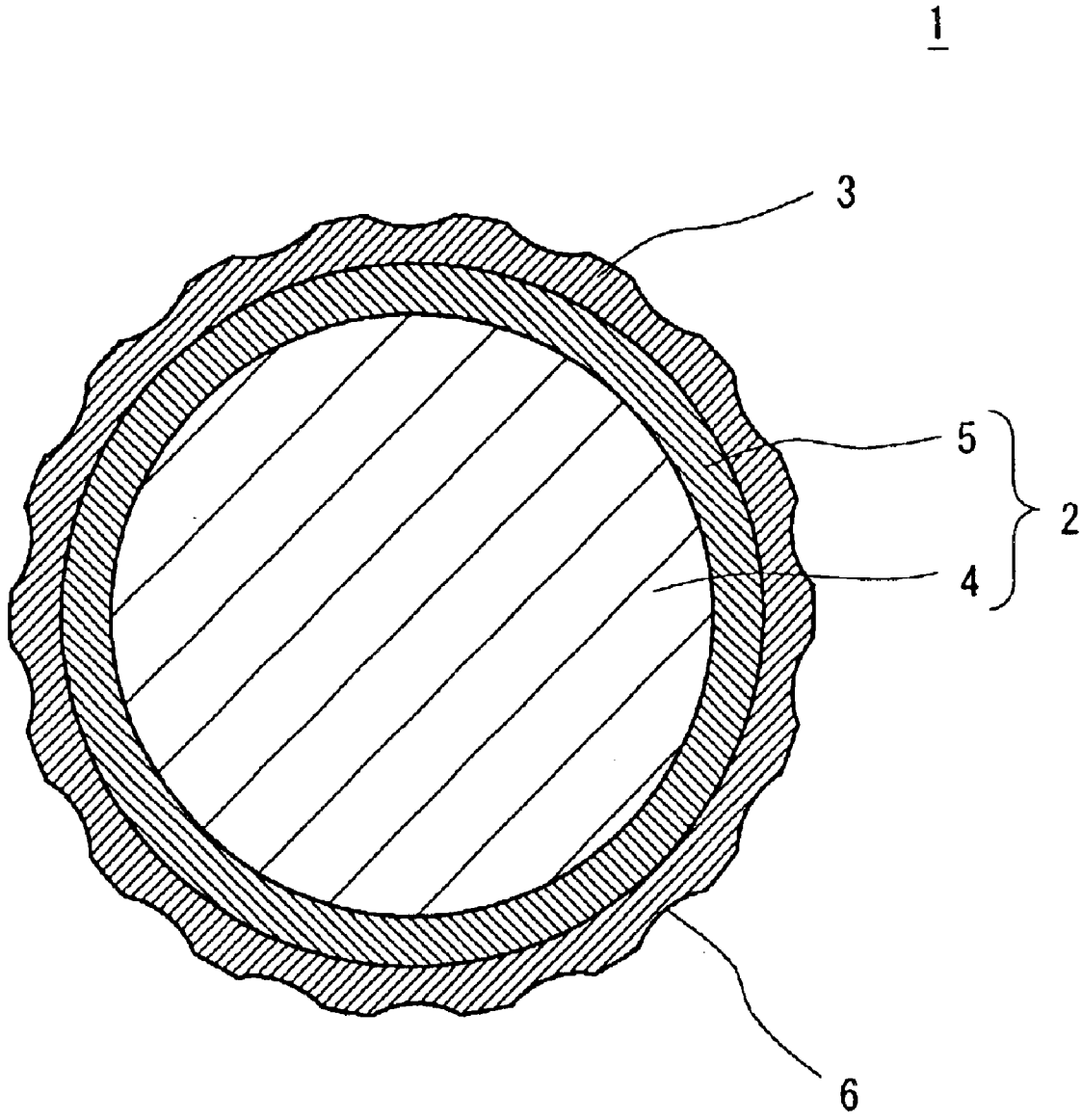
FIG. 1 is a schematic cross-sectional view illustrating a golf ball according to one embodiment of the present invention.

A golf ball 1 depicted in FIG. 1 has a spherical core 2 and a cover 3. The core 2 is composed of a center 4 and a mid layer 5. Numerous dimples 6 are formed on the surface of the cover 3. This golf ball 1 has a paint layer and a mark layer to the external side of the cover 3, although not shown in the Figure. This golf ball 1 has a diameter of from 40 mm to 45 mm in general, and in particular, of from 42 mm to 44 mm. In the light of the reduction of air resistance in the range to comply with a rule defined by United States Golf Association (USGA), the diameter is preferably 42.67 mm or greater and 42.80 mm or less. The weight of the golf ball 1 is 40 g or greater and 50 g or less, and particularly 44 g or greater and 47 g or less. In light of the elevation of inertia in the range to comply with a rule defined by United States Golf Association, the golf ball 1 preferably has a weight of 45.00 g or greater and 45.93 g or less.

Shore D hardness Hc of the cover 3 is set to be equal to or greater than 58. In other words, the cover 3 has a relatively high hardness. By employing a cover 3 having high hardness, a resilience performance of the golf ball 1 is improved, leading to an improvement in the flight performance. In this respect, hardness Hc of the cover 3 is more preferably equal to or greater than 59, even more preferably equal to or greater than 60, and particularly preferably equal to or greater than 62. When hardness Hc of the cover 3 is too high, the feel at impact of the golf ball 1 deteriorates. Therefore, the hardness Hc is preferably equal to or less than 70, more preferably equal to or less than 68, and particularly, preferably equal to or less than 65.

Difference (Hc-Hm) between Shore D hardness Hc of the cover 3 and Shore D hardness Hm of the mid layer 5 is preferably equal to or greater than 3. The feel at impact of the golf ball 1 is thereby improved. In this respect, the difference of hardness (Hc-Hm) is more preferably equal to or greater than 5, even more preferably equal to or greater than 8, and particularly, preferably equal to or greater than 10. When the difference between the hardness (Hc-Hm) is extremely large, the resilience performance of the golf ball 1 is reduced. In this respect, the difference of hardness (Hc-Hm) is preferably equal to or less than 20, and particularly, preferably equal to or less than 18.

Shore D hardness Hm of the mid layer 5 is preferably equal to or less than 60. The feel at impact of the golf ball 1 is thereby improved. In this respect, the hardness Hm is more preferably equal to or less than 58, even more preferably equal to or less than 55, and particularly preferably equal to or less than 50. When hardness Hm is extremely small, the resilience performance of the golf ball 1 becomes insufficient. In this respect, the hardness Hm is preferably equal to or greater than 35, more preferably equal to or greater than 40, and particularly, preferably equal to or greater than 45.

The Shore D hardness is measured in accordance with a standard of "ASTM-D 2240-68", with a Shore D type spring hardness scale. When the sample to be measured consists of a resin composition, hardness is measured with a slab molded from this resin composition. When the sample to be measured consists of a rubber composition to be crosslinked, hardness is measured with a slab prepared by crosslinking the rubber composition under the identical condition of a subject crosslinking condition.

Figure 2:
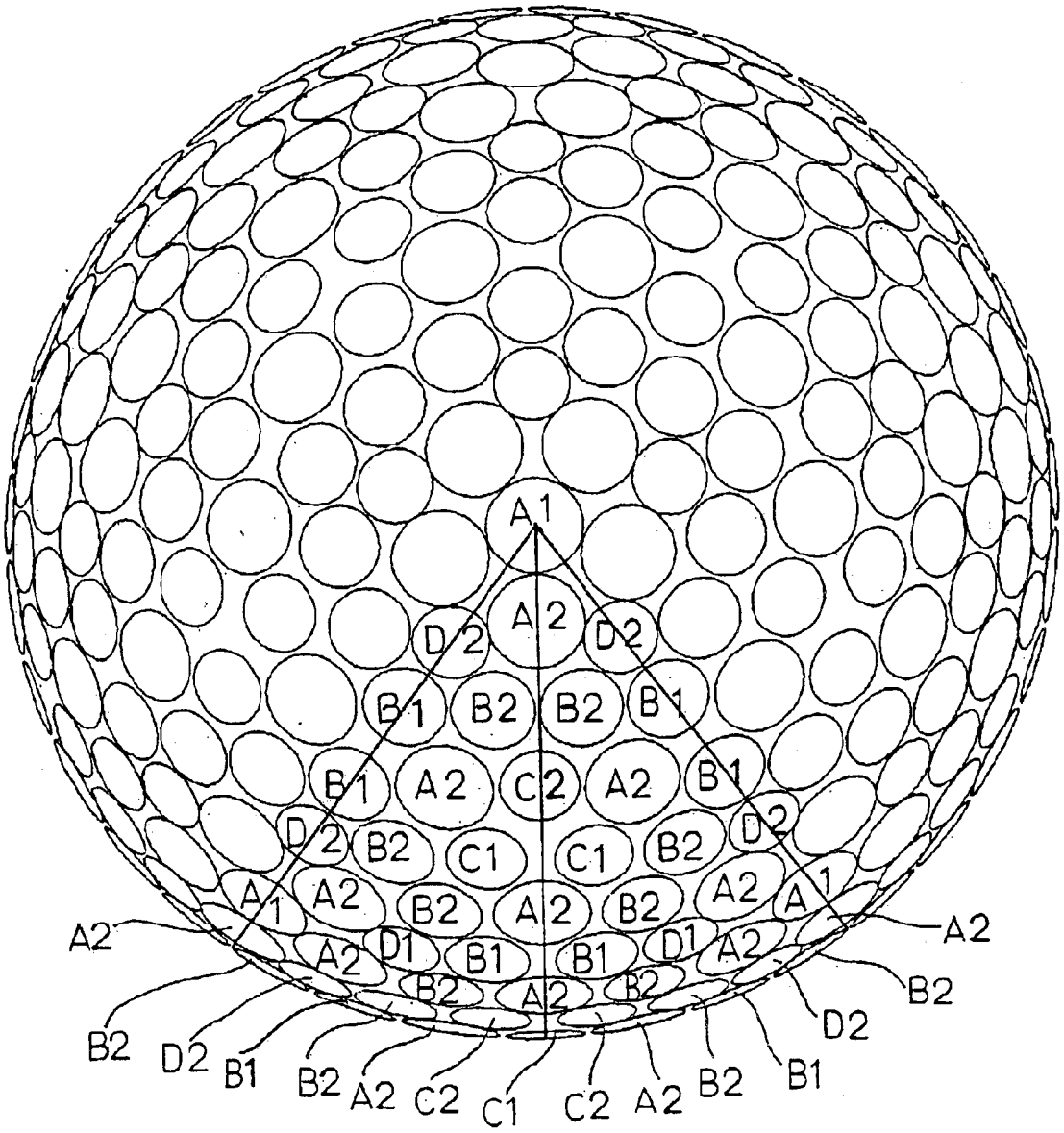
FIG. 2 is an enlarged plan view illustrating the golf ball shown in FIG. 1.
Figure 3:
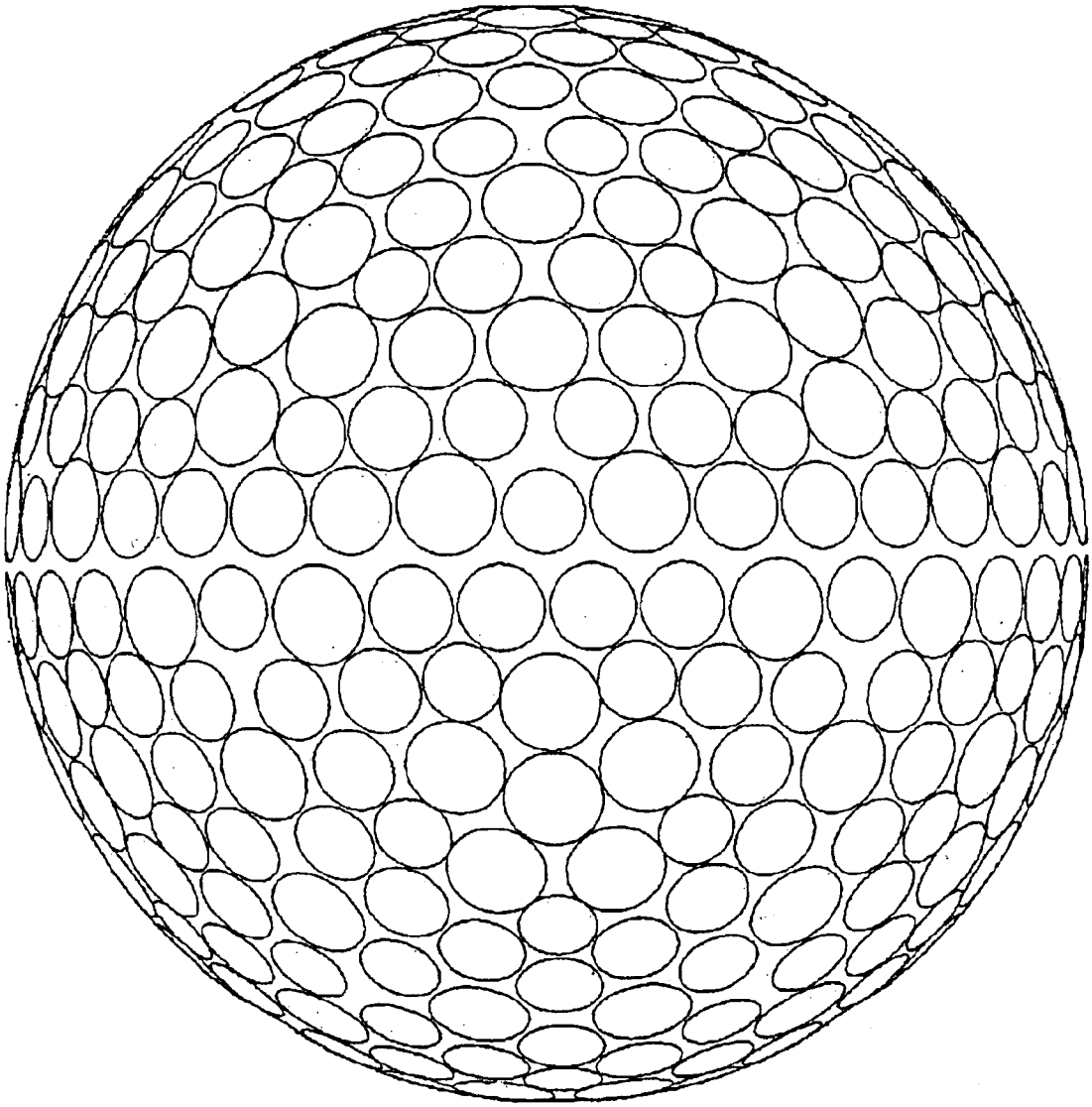
FIG. 3 is an enlarged front view illustrating the golf ball shown in FIG. 1.

FIG. 2 is an enlarged plan view illustrating the golf ball 1 shown in FIG. 1, and FIG. 3 is a front view of the same. FIG. 2 illustrates the kinds of dimples 6 for one unit which is provided by dividing the surface of the golf ball 1 into 10 equivalent units. The plane shape of all the dimples 6 is circular. This golf ball 1 includes A1 dimples having a diameter of 4.05 mm and a depth of 0.1763 mm, A2 dimples having a diameter of 4.05 mm and a depth of 0.1763 mm, B1 dimples having a diameter of 3.50 mm and a depth of 0.1518 mm, B2 dimples having a diameter of 3.50 mm and a depth of 0.1518 mm, C1 dimples having a diameter of 3.35 mm and a depth of 0.1458 mm, C2 dimples having a diameter of 3.35 mm and a depth of 0.5658 mm, D1 dimples having a diameter of 3.20 mm and a depth of 0.5600 mm, and D2 dimples having a diameter of 3.20 mm and a depth of 0.5600 mm. The number of the A1 dimple is 12; the number of the A2 dimple is 120; the number of the B1 dimple is 60; the number of the B2 dimple is 120; the number of the C1 dimple is 30; the number of the C2 dimple is 30; the number of the D1 dimple is 20; and the number of the D2 dimple is 40. The total number of dimples on this golf ball 1 is 432.

Figure 4:
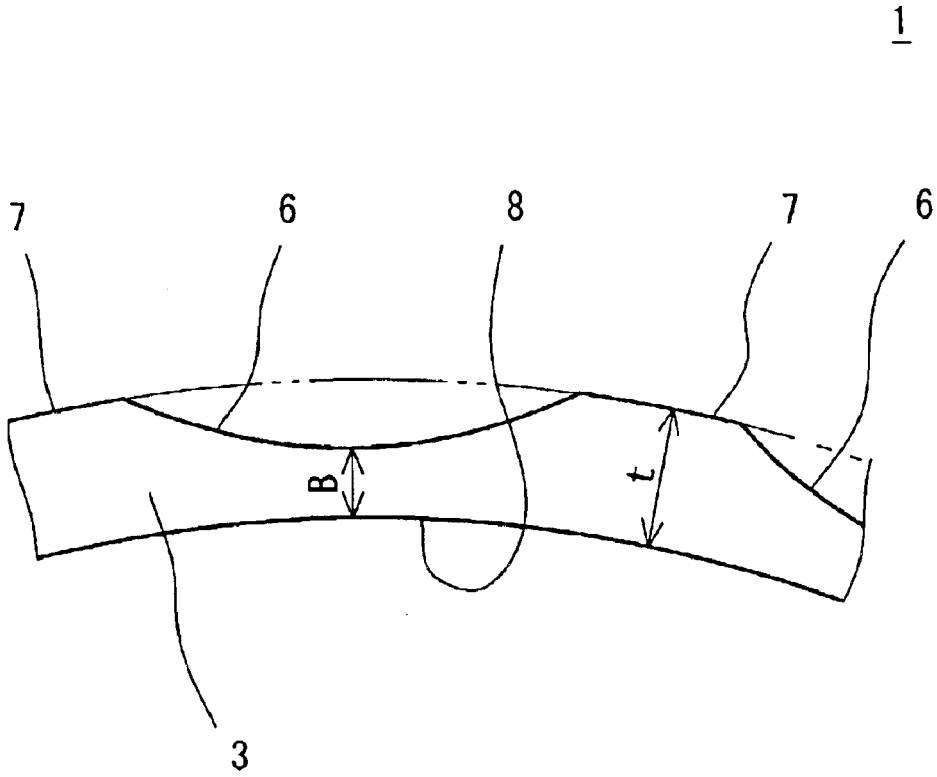
FIG. 4 is an enlarged cross-sectional view illustrating the golf ball shown in FIG. 1.

FIG. 4 is an enlarged cross-sectional view illustrating a part of the golf ball 1 shown in FIG. 1. In this Figure, the cover 3 and the dimples 6 are depicted. A phantom spherical surface (A surface of the golf ball 1 when it was postulated that no dimple exists) is depicted by a chain double-dashed line. The surface of the cover 3 is composed of dimples 6 and land portions 7. The cover 3 is the thickest immediately below the land portion 7, and the thinnest is immediately below the bottom of the dimple 6.

In FIG. 4, a thickness of the cover 3 immediately below the land part 7 is depicted by a double-sided arrowhead t. The nominal thickness T of this golf ball 1 is calculated by: envisioning a regular octahedron inscribing the phantom spherical surface; determining land parts 7 that are closest to each of the six apexes of this regular octahedron; and averaging the thicknesses t measured at these six land parts 7.

In FIG. 4, the height of the bottom of the dimple 6 is depicted by a double-sided arrowhead B. This height B is a distance between an underside surface 8 of the cover 3 (a surface that contacts with the core 2) and the deepest portion of the dimple 6. In other words, the height B is the shortest distance between an underside surface 8 of the cover 3 and the dimple 6.

The ratio (BIT), which is a ratio of the height B of a bottom of the dimple 6 to a nominal thickness T of the cover 3 is an indication representing the thickness of the cover 3 immediately below the dimple. The ratio (B/T) of the A1 dimple of the golf ball 1 shown in FIGS. 1–4 is 0.864; the ratio (B/T) of the A2 dimple is 0.864; the ratio (B/T) of the B1 dimple is 0.883; a ratio (B/T) of the B2 dimple is 0.883; the ratio (B/T) of the C1 dimple is 0.888; the ratio (B/T) of the C2 dimple is 0.565; the ratio (B/T) of the D1 dimple is 0.569; and a ratio (B/T) of the D2 dimple is 0.569. In this golf ball 1, the number of dimples having the ratio (B/T) of equal to or less than 80 is 90. The proportion R1 of the number of dimples 6 having a ratio (B/T) of equal to or less than 0.80 (90 dimples) based on the total number of dimples (432 dimples) is 20.8%.

The proportion R1 of the present golf ball 1 is greater in comparison with the proportion of R1 of conventional golf balls. In golf ball 1, there exist numerous sites where the thickness of the cover 3 is relatively small (hereinafter referred to as "thin-walled site"). Golf ball 1 is excellent in feel at impact. Although grounds for such excellent feel at impact of this golf ball 1 are not certain, in detail, it is speculated that existing numerous thin-walled sites may exert some influences on the behavior of the golf ball 1 at impact to reduce the impulsive force. Dimples 6 have been originally provided for the purpose of improving the aerodynamic characteristics of the golf ball 1, and play a role of improving the flight performance by optimizing the trajectory following the impact. According to the present invention, the dimples play a role in improving the feel at impact, in addition to their original role of improving the aerodynamic characteristics, due to setting the proportion R1 to be in a predetermined range.

According to the findings acquired by the present inventor, satisfactory feel at impact can be achieved even in the instance where a cover 3 having high hardness is employed by setting the proportion R1 to be equal to or greater than 10%. By providing a high proportion R1 as well as a cover 3 having a high hardness, the feel at impact and the resilience performance of the golf ball can be concurrently accomplished.

In light of the feel at impact, the proportion R1 is preferably equal to or greater than 15%, and more preferably equal to or greater than 20%. When the proportion R1 is too large, the resilience performance of the golf ball 1 becomes insufficient. Therefore, the proportion R1 is preferably equal to or less than 95%, more preferably equal to or less than 90%, even more preferably equal to or less than 85%, even more preferably equal to or less than 70%, and particularly, preferably equal to or less than 60%.

A site with the cover 3 having a thickness being extremely small is in danger of becoming an origin of a crack. In light of durability of the golf ball 1, it is preferred that sites with the cover 3 having a thickness being extremely small are as few as possible. In particular, a proportion R2 of number of dimples 6 having a ratio (B/T) of less than 0.40 occupied in total number of the dimples is preferably equal to or less than 10%, more preferably equal to or less than 5%, and ideally 0%. In the golf ball 1 shown in FIGS. 1–4, the proportion R2 is 0%.

Mean value of the ratio (B/T) is preferably equal to or less than 0.86. When the mean value is beyond this range, a feel at impact of the golf ball 1 may become deteriorated. In this respect, the mean value is more preferably equal to or less than 0.84, and particularly preferably equal to or less than 0.82. When the mean value is too small, a resilience performance of the golf ball 1 may become insufficient. In this respect, the mean value is preferably equal to or greater than 0.50, more preferably equal to or greater than 0.60, and particularly preferably equal to or greater than 0.70. The mean value is calculated by summing values of the ratio (B/T) for all the dimples 6, and dividing this summed value by total number of the dimples. In the golf ball 1 shown in FIGS. 1–4, a mean value of the ratio (B/T) is 0.812.

Surface area occupation percentage Y of the dimples 6 is preferably70% or greater and90% or less. When the surface area occupation percentage Y is less than the above range, lift force of the golf ball during the flight may be deficient. In this respect, the surface area occupation percentage Y is more preferably equal to or greater than 72%, and particularly preferably equal to or greater than 74%. When the surface area occupation percentage Y is beyond the above range, a trajectory of the golf ball 1 may become too high. In this respect, the surface area occupation percentage Y is more preferably equal to or less than 88%, and particularly preferably equal to or less than 86%. The surface area occupation percentage Y of the golf ball 1 shown in FIGS. 1–4 is 77.6%.

The term "surface area occupation percentage Y" herein means a value obtained by dividing a summation of the area of all the dimples 6 with the surface are of the phantom sphere. "The area of dimple 6" herein means the area of a plan shape of the dimple 6 (a shape of a contour of the dimple 6 when it is observed by viewing the center of the golf ball 1 at infinity). In an instance of a circular dimple 6 having a diameter of d, an area s is calculated by the following formula.

$$s=(d/2)^2\times\pi$$

Total volume V of the dimples 6 is preferably 400 $mm^3$ or greater and 700 $mm^3$ or less. When the total volume V is less than the above range, hopping trajectory may be provided. In this respect, the total volume V is more preferably equal to or greater than 420 $mm^3$, and particularly preferably equal to or greater than 430 $mm^3$. When the total volume V is beyond the above range, dropping trajectory may be provided. In this respect, the total volume V is more preferably equal to or less than 680 $mm^3$, even more preferably equal to or less than 660 $mm^3$, and particularly preferably equal to or less than 570 $mm^3$. Total volume V of the golf ball 1 shown in FIGS. 1–4 is 517 $mm^3$.

"Total volume V" herein means a summation of the volume v of all the dimples 6. "Volume v of the dimple 6" herein means volume of a space surrounded by a phantom spherical surface and the surface of a dimple 6.

The diameter of the dimple 6 is preferably 2.0 mm or greater and 6.0 mm or less. When the diameter is less than the above range, a travel distance of the golf ball 1 may become insufficient. In this respect, the diameter is more preferably equal to or greater than 2.2 mm, even more preferably equal to or greater than 2.3 mm, and particularly preferably equal to or greater than 2.5 mm. When the diameter is beyond the above range, the aerodynamically symmetric property of the golf ball 1 may become insufficient. In this respect, the diameter is more preferably equal to or less than 5.8 mm, even more preferably equal to or less than 5.6 mm, and particularly preferably equal to or less than 5.0 mm. In light of the flight performance, it is preferred that multiple kinds of dimples 6 are provided having a different diameter each other. In this instance, it is preferred that the diameters are set to be in the range described above for all of the kinds.

Depth of the dimple 6 (a distance between the phantom spherical face and the deepest portion of the dimple 6) is determined ad libitum so that the ratio (B/T) fall within the range as described above. In general, the depth is set to be 0.05 mm or greater and 1.00 mm or less, and particularly, be 0.10 mm or greater and 0.80 mm or less. In light of the flight performance, it is preferred that multiple kinds of dimples 6 are provided having a different depth each other. In this instance, it is preferred that the depths are set to be in the range described above for all of the kinds. Preferably, three or more kinds of dimples 6 are provided having a different diameter or depth.

In stead of the circular dimples 6, or together with the circular dimples 6, non-circular dimples may be formed. Specific examples of the non-circular dimple include polygonal dimples, elliptical dimples, tear drops-like shaped dimples and the like. The area of the non-circular dimples is preferably 3 $mm^3$ or greater and 29 $mm^3$ or less.

Total number of the dimples 6 is preferably 250 or greater and 500 or less. When the total number is less than the above range, there is a possibility that the fundamental feature of the golf ball 1 which is a substantially spherical body may not be sustained. In this respect, total number is more preferably equal to or more than 260, even more preferably equal to or more than 280, and particularly preferably equal to or more than 300. When the total number is beyond the above range, a drag coefficient (Cd) may become so large that the travel distance becomes insufficient. In this respect, total number is more preferably equal to or less than 480, and particularly preferably equal to or less than 460.

Size of the dimple 6 can be determined by actual measurement of the golf ball 1. The golf ball 1 generally has a paint layer on its surface, and thus accurate measurement of the size may involve difficulties owing to the influences of this paint layer. According to the present invention, the golf ball 1 prior to the treatment for painting may be actually measured as a matter of convenience, or alternatively, size of the mold may be actually measured.

Nominal thickness T of the cover 3 is preferably 0.2 mm or greater and 2.5 mm or less. When the nominal thickness T is less than the above range, a resilience performance and durability may become insufficient. In this respect, the nominal thickness T is more preferably equal to or greater than 0.3 mm, and particularly preferably equal to or greater than 0.5 mm. When the nominal thickness T is beyond the range described above, insufficient feel at impact may be experienced. In this respect, the nominal thickness T is more preferably equal to or less than 2.0 mm, even more preferably equal to or less than 1.7 mm, and particularly preferably equal to or less than 1.5 mm.

In general, the cover 3 is composed of a resin composition. Illustrative examples of particularly preferable base resin include ionomer resins, polyesters, polyurethanes polyolefins and various kinds of thermoplastic elastomers, and any mixture thereof may be used.

Of the ionomer resins, copolymers of α-olefin and α,β-unsaturated carboxylic acid having 3 to 8 carbon atoms in which part of the carboxylic acid is neutralized with a metal ion are suitable. As the α-olefin herein, ethylene and propylene are preferred. Acrylic acid and methacrylic acid are preferred as the α,β-unsaturated carboxylic acid. Metal ions for the neutralization include: alkaline metal ions such as sodium ion, potassium ion, lithium ion and the like; bivalent metal ions such as zinc ion, calcium ion, magnesium ion and the like; trivalent metal ions such as aluminum ion, neodymium ion and the like. The neutralization may also be carried out with two or more kinds of metal ions. In light of the resilience performance and durability of the golf ball 1, particularly suitable metal ions are sodium ion, zinc ion, lithium ion and magnesium ion.

Preferable thermoplastic elastomers include thermoplastic polyurethane elastomers, thermoplastic polyamide elastomers, thermoplastic polyester elastomers, thermoplastic styrene elastomers, and thermoplastic elastomers having OH groups at their ends. Two or more kinds of thermoplastic elastomers may be used in combination. In light of the resilience performance of the golf ball 1, thermoplastic polyester elastomers and thermoplastic styrene elastomers are particularly suitable.

Thermoplastic styrene elastomers (thermoplastic elastomers containing styrene blocks) include styrene-butadiene-styrene block copolymers (SBS), styrene-isoprene-styrene block copolymers (SIS), styrene-isoprene-butadiene-styrene block copolymers (SIBS) hydrogenated SBS, hydrogenated SIS and hydrogenated SIBS. Exemplary hydrogenated SBS include styrene-ethylene-butylene-styrene block copolymers (SEBS) Exemplary hydrogenated SIS include styrene-ethylene-propylene-styrene block copolymers (SEPS) Exemplary hydrogenated SIBS include styrene-ethylene-ethylene-propylene-styrene block copolymers (SEEPS).

To the cover 3, may be blended coloring agents such as titanium dioxide, fillers such as barium sulfate, dispersants, anti-aging agents, ultraviolet absorbents, light stabilizers, fluorescent agents, fluorescent brightening agents and the like at an appropriate amount as needed. The cover 3 may be blended with powder of highly dense metal such as tungsten, molybdenum and the like for the purpose of adjusting specific gravity.

In general, the center 4 is obtained through crosslinking of a rubber composition. Examples of suitable base rubber for use in the rubber composition include polybutadienes, polyisoprenes, styrene-butadiene copolymers, ethylene-propylene-diene copolymers, natural rubbers and the like. Two or more kinds of these rubbers may be used in combination. In view of the resilience performance, polybutadienes are preferred. Even in the case where another rubber is used in combination with a polybutadiene, to employ a polybutadiene as a predominant component is preferred. More specifically, it is preferred that a proportion of polybutadiene occupied in total base rubber be equal to or greater than 50% by weight, and particularly equal to or greater than 80% by weight. Among polybutadienes, high cis-polybutadienes are preferred, which have a percentage of cis-1, 4 bond of equal to or greater than 40%, and particularly equal to or greater than 80%.

Mode of crosslinking in the center 4 is not particularly limited. Crosslinking agents which can be used include co-crosslinking agents, organic peroxides, sulfur and the like. For the ground that the resilience performance of the golf ball 1 can be improved, it is preferred that a co-crosslinking agent and an organic peroxide are used in combination. Preferable co-crosslinking agents in view of the resilience performance include monovalent or bivalent metal salts of β,β-unsaturated carboxylic acid having 2 to 8 carbon atoms. Specific examples of the preferable co-crosslinking agent include zinc acrylate, magnesium acrylate, zinc methacrylate and magnesium methacrylate. In particular, zinc acrylate is preferred which can result in a high resilience performance.

As a co-crosslinking agent, α,β-unsaturated carboxylic acid having 2 to 8 carbon atoms, and a metal oxide may be blended. Both components react in the rubber composition to give a salt. Preferable α,β-unsaturated carboxylic acids include acrylic acid and methacrylic acid, and in particular, acrylic acid is preferred. Preferable metal oxides include zinc oxide and magnesium oxide, and in particular, zinc oxide is preferred.

The amount of the co-crosslinking agent to be blended is preferably 10 parts or greater and 50 parts or less per 100 parts (by weight) of the base rubber. When the amount to be blended is less than the above range, a resilience performance of the golf ball 1 may become insufficient. In this respect, the amount to be blended is more preferably equal to or greater than 12 parts, and particularly preferably equal to or greater than 15 parts. When the amount to be blended is beyond the above range, a feel at impact of the golf ball 1 may be hard. In this respect, the amount to be blended is particularly preferably equal to or less than 45 parts.

In the rubber composition for use in the center 4, an organic peroxide may be preferably blended. The organic peroxide serves as a crosslinking agent in conjunction with the above-mentioned metal salt of α,β-unsaturated carboxylic acid, and also serves as a curing agent. By blending the organic peroxide, the resilience performance of the golf ball 1 may be improved. Suitable organic peroxides include dicumyl peroxide, 1,1-bis(t-butylperoxy)-3,3,5-trimethylcyclohexane, 2,5-dimethyl-2,5-di(t-butylperoxy) hexane and di-t-butyl peroxide. Particularly versatile organic peroxide is dicumyl peroxide.

The amount of the organic peroxide to be blended is preferably 0.1 part or greater and 3.0 parts or less per 100 parts of the base rubber. When the amount to be blended is less than the above range, a resilience performance of the golf ball 1 may become insufficient. In this respect, the amount to be blended is more preferably equal to or greater than 0.2 part, even more preferably equal to or greater than 0.4 part, and particularly preferably equal to or greater than 0.5 part. When the amount to be blended is beyond the above range, a feel at impact of the golf ball 1 may become hard. In this respect, the amount to be blended is particularly preferably equal to or less than 2.5 parts.

The center 4 may be blended with a filler for the purpose of adjusting specific gravity and the like. Examples of suitable filler include inorganic salts such as zinc oxide, barium sulfate, calcium carbonate and the like; and powder of highly dense metal such as tungsten, molybdenum and the like. The amount of the filler to be blended is determined ad libitum so that the intended specific gravity of the center 4 can be accomplished. Preferable filler is zinc oxide because it serves not only as a mere agent for adjusting specific gravity but also as a crosslinking activator.

Various kinds of additives such as sulfur, anti-aging agents, coloring agents, plasticizers, dispersants and the like may be blended at an appropriate amount to the center 4 as needed. The center 4 may be further blended with powder of a crosslinked rubber or synthetic resin powder. Common crosslinking temperature of the center 4 is set to be from 140° C. or greater and 180° C. or less, with the crosslinking time period of 10 minutes or longer and 60 minutes or less.

The diameter of the center 4 is set to be 25 mm or greater and 41 mm or less, and particularly 27 mm or greater and 40 mm or less.

The mid layer 5 may be composed of a crosslinked rubber or may be composed of a resin composition. When it is composed of a crosslinked rubber, the base rubber thereof may be similar to those for the center 4 as described above. Furthermore, similar co-crosslinking agent and organic peroxide to those which may be blended in the center 4 as described above can be blended. The amount of the co-crosslinking agent to be blended is preferably 10 parts or greater and 60 parts or less per 100 parts of the base rubber. When the amount to be blended is less than the above range, a resilience performance of the golf ball 1 may become insufficient. In this respect, the amount to be blended is more preferably equal to or greater than 15 parts, and particularly preferably equal to or greater than 20 parts. When the amount to be blended is beyond the above range, a feel at impact of the golf ball 1 may become deteriorated. In this respect, the amount to be blended is more preferably equal to or less than 50 parts, even more preferably equal to or less than 40 parts, and particularly preferably equal to or less than 35 parts.

The amount of the organic peroxide to be blended in the mid layer 5 is preferably 0.1 part or greater and 8.0 parts or less per 100 parts of the base rubber. When the amount to be blended is less than the above range, a resilience performance of the golf ball 1 may become insufficient. In this respect, the amount to be blended is more preferably equal to or greater than 0.2 part, even more preferably equal to or greater than 0.3 part, and particularly preferably equal to or greater than 0.5 part. When the amount to be blended is beyond the above range, a feel at impact of the golf ball 1 may become hard. In this respect, the amount to be blended is more preferably equal to or less than 7.0 parts, even more preferably equal to or less than 6.0 parts, and particularly preferably equal to or less than 4.0 parts.

Also in the mid layer 5, may be blended with similar filler and various kinds of additives to those which may be blended in the center 4 as described above.

When the mid layer 5 is composed of a resin composition, similar ionomer resins, polyesters, polyurethanes polyolefins and various kinds of thermoplastic elastomers to those for the cover 3 as described above can be employed.

Thickness of the mid layer 5 is preferably 0.2 mm or greater and 4.0 mm or less. When the thickness is less than the above range, a feel at impact of the golf ball 1 may become insufficient. In this respect, the thickness is more preferably equal to or greater than 0.3 mm, and particularly preferably equal to or greater than 0.5 mm. When the thickness is beyond the above range, a resilience performance of the golf ball 1 may become insufficient. In this respect, the thickness is more preferably equal to or less than 3.0 mm, even more preferably equal to or less than 2.0 mm, and particularly preferably equal to or less than 1.5 mm.

The center 4 of the golf ball 1 depicted in FIG. 1 is composed of a single layer, however, a center composed of two or more layers may be employed. Another mid layer may be provided between the center 4 and the mid layer 5, and another mid layer may be provided between the mid layer 5 and the cover 3. A core composed of a single layer without including a mid layer may be employed.

EXAMPLES

Specifications of a canter, a mid layer, a cover and dimples were defined as presented in the Table 1 below, and golf balls of Examples 1 to 3 and Comparative Examples 1 to 4 were obtained. The core of the golf balls of Example 3 and Comparative Example 3 did not include a mid layer, and composed of a single layer. Details of blending of the center and the mid layer are presented in Table 2; details of blending of the cover are presented in Table 3; and details of specifications of the dimples are presented in Table 4.

TABLE 1

| | | Specifications of golf ball | | | | | | |
|---|---|---|---|---|---|---|---|---|
| | | Example 1 | Example 2 | Example 3 | Com. Example 1 | Com. Example 2 | Com. Example 3 | Com. Example 4 |
| Center | type of blending | a | b | c | a | b | c | a |
| | diameter (mm) | 36.1 | 36.1 | 40.1 | 36.1 | 36.1 | 40.1 | 36.1 |
| Mid layer | type of blending | c | c | none | c | c | none | c |
| | thickness (mm) | 2.0 | 2.0 | | 2.0 | 2.0 | | 2.0 |

TABLE 1-continued

| Specifications of golf ball | | Example 1 | Example 2 | Example 3 | Com. Example 1 | Com. Example 2 | Com. Example 3 | Com. Example 4 |
|---|---|---|---|---|---|---|---|---|
| Cover | type of blending | X | Y | Z | X | Z | Y | X |
| | nominal thickness (mm) | 1.3 | 1.3 | 1.3 | 1.3 | 1.3 | 1.3 | 1.3 |
| Dimple type | | I | II | I | III | I | III | IV |

TABLE 2

| Type of blending of center and mid layer | | | |
|---|---|---|---|
| Type | a | b | c |
| polybutadiene *1 | 100 | 100 | 100 |
| zinc acrylate | 24.5 | 25.0 | 26.0 |
| zinc oxide | 10 | 10 | 10 |
| barium sulfate *2 | appropriate amount | appropriate amount | appropriate amount |
| dicumyl peroxide | 0.8 | 0.8 | 0.8 |

*1: "BR11", trade name by JSR Corporation

*2: varying amount to make golf ball weight be 45.4 g

TABLE 3

| Type of blending of cover | | | |
|---|---|---|---|
| Type | X | Y | Z |
| ionomer resin 1605 *1 | 45 | 60 | 20 |
| ionomer resin 1706 *2 | 45 | 40 | 20 |
| ionomer resin 1855 *3 | — | — | 60 |
| thermoplastic styrene elastomer *4 | 10 | — | — |
| titanium oxide | 3 | 3 | 3 |
| Hardness Hc (Shore D) | 60 | 63 | 56 |

*1: "Himilan 1605", trade name by Mitsui-Dupont Polychemical Co. Ltd.

*2: "Himilan 1706", trade name by Mitsui-Dupont Polychemical Co. Ltd.

*3: "Himilan 1855", trade name by Mitsui-Dupont Polychemical Co. Ltd.

*4: "Rabalon ® SR04", trade name by Mitsubishi Chemical Corporation

TABLE 4

| Specifications of dimples | | | | | | | | | |
|---|---|---|---|---|---|---|---|---|---|
| Type | kind | Number | Diameter (mm) | depth (mm) | volume ($mm^3$) | (B/T) | total volume ($mm^3$) | R1 (%) | (B/T) mean value |
| I | A1 | 12 | 4.05 | 0.1763 | 1.136 | 0.864 | 517 | 20.8 | 0.812 |
| | A2 | 120 | 4.05 | 0.1763 | 1.136 | 0.864 | | | |
| | B1 | 60 | 3.50 | 0.1518 | 0.731 | 0.883 | | | |
| | B2 | 120 | 3.50 | 0.1518 | 0.731 | 0.883 | | | |
| | C1 | 30 | 3.35 | 0.1458 | 0.643 | 0.888 | | | |
| | C2 | 30 | 3.35 | 0.5658 | 2.559 | 0.565 | | | |
| | D1 | 20 | 3.20 | 0.5600 | 2.318 | 0.569 | | | |
| | D2 | 40 | 3.20 | 0.5600 | 2.318 | 0.569 | | | |
| II | A1 | 12 | 4.05 | 0.6463 | 4.250 | 0.503 | 515 | 16.7 | 0.826 |
| | A2 | 120 | 4.05 | 0.1813 | 1.168 | 0.861 | | | |
| | B1 | 60 | 3.50 | 0.5718 | 2.817 | 0.560 | | | |
| | B2 | 120 | 3.50 | 0.1518 | 0.731 | 0.883 | | | |
| | C1 | 30 | 3.35 | 0.1458 | 0.643 | 0.888 | | | |
| | C2 | 30 | 3.35 | 0.1458 | 0.643 | 0.888 | | | |
| | D1 | 20 | 3.20 | 0.1200 | 0.483 | 0.908 | | | |
| | D2 | 40 | 3.20 | 0.1200 | 0.483 | 0.908 | | | |
| III | A1 | 12 | 4.05 | 0.2263 | 1.459 | 0.826 | 516 | 6.9 | 0.821 |
| | A2 | 120 | 4.05 | 0.2263 | 1.459 | 0.826 | | | |
| | B1 | 60 | 3.50 | 0.2018 | 0.972 | 0.845 | | | |
| | B2 | 120 | 3.50 | 0.2018 | 0.972 | 0.845 | | | |
| | C1 | 30 | 3.35 | 0.1958 | 0.864 | 0.849 | | | |
| | C2 | 30 | 3.35 | 0.5658 | 2.559 | 0.565 | | | |
| | D1 | 20 | 3.20 | 0.1900 | 0.765 | 0.854 | | | |
| | D2 | 40 | 3.20 | 0.1900 | 0.765 | 0.854 | | | |
| IV | A | 264 | 3.80 | 0.2597 | 1.513 | 0.865 | 515 | 0 | 0.875 |
| | B | 120 | 3.20 | 0.2100 | 0.833 | 0.885 | | | |
| | C | 48 | 2.35 | 0.1574 | 0.330 | 0.904 | | | |

[Measurement of Amount of Compressive Deformation]

The golf ball was first placed on a hard plate made of metal. Next, a cylinder made of metal was rendered to descend gradually toward the golf ball, and thus the golf ball, which was intervened between the bottom face of this cylinder and the hard plate, was deformed. Then, a migration distance of the cylinder was measured, starting from the state in which initial load of 98 N was applied to the golf ball up to the state in which final load of 1274 N was applied thereto. This value of migration distance was referred to as an amount of compressive deformation. The results thus obtained are shown in Table 5 below.

[Evaluation of Feel at Impact]

Using a driver with a metal head, golf balls were hit by 10 senior golfers. Thus, the feel at impact was evaluated. Those which were evaluated as satisfactory in the feel at impact by 8 or more golfers among the ten golfers were assigned "A", those which were evaluated as satisfactory by from 6 to 7 golfers were assigned "B", those which were evaluated as satisfactory by from 4 to 5 golfers were assigned "C", and those which were evaluated as satisfactory by 3 or less golfers were assigned "D". The results are presented in Table 5 below.

TABLE 5

Results of evaluation

| | Example 1 | Example 2 | Example 3 | Com. Example 1 | Com. Example 2 | Com. Example 3 | Com. Example 4 |
|---|---|---|---|---|---|---|---|
| hardness of mid layer Hm | 50 | 50 | — | 50 | 50 | — | 50 |
| hardness of cover Hc | 60 | 63 | 60 | 60 | 56 | 63 | 60 |
| difference of hardness (Hc–Hm) | 10 | 13 | — | 10 | 6 | — | 10 |
| Proportion R1 (%) | 20.8 | 16.7 | 20.8 | 6.9 | 20.8 | 6.9 | 0 |
| mean value of (B/T) | 0.812 | 0.826 | 0.812 | 0.821 | 0.812 | 0.821 | 0.875 |
| amount of compressive deformation (mm) | 3.0 | 2.8 | 2.8 | 3.0 | 3.1 | 2.7 | 3.0 |
| resilience coefficient (index) | 1.00 | 1.02 | 1.01 | 1.00 | 0.98 | 1.03 | 1.00 |
| Durability (index) | 100 | 100 | 104 | 100 | 110 | 98 | 100 |
| travel distance (m) | 194 | 197 | 196 | 194 | 191 | 198 | 194 |
| Feel at impact | A | A | B | C | A | D | C |

[Measurement of Resilience Coefficient]

To the golf ball, was impacted a hollow cylinder made of aluminum of which weight being 200 g at a velocity of 40 m/s. Then, velocity of the hollow cylinder prior to and after the impact, and the velocity of the golf ball after the impact we remeasured. Thus, a resilience coefficient was determined in accordance with a law of conservation of momentum. Mean values of data which resulted from 12 times measurement are shown in Table 5 below as indices on the basis of the resilience coefficient of the golf ball of Comparative Example 1 which was converted to be 1.00.

[Evaluation of Durability]

A driver with a metal head (Sumitomo Rubber Industries, Ltd., "XXIO W#1", loft: 8°, hardness of shaft: X) was equipped with a swing machine (manufactured by True Temper Co.). Then the machine was conditioned to give head speed of 45 m/sec, and golf balls were hit therewith. A plate for collision made of steel was placed on the line of flight, and the golf ball immediately after impact was rendered to collide onto the collision plate. This process was repeated until the golf ball cracked, and number of times of the collision until the onset of cracking was counted. Indices calculated on the basis of the number of times of the collision of the golf ball of Comparative Example 1, which was converted to be 100, are shown in Table 5 below.

[Travel Distance Test]

A driver with a metal head ("XXIO W#1" described above) was equipped with a swing machine (manufactured by True Temper Co.). Then the machine was conditioned to give head speed of 45 m/sec, and golf balls were hit therewith. Travel distance (i.e., the distance from the launching point to the point where the ball stopped) was thus measured. Mean values of data which resulted from 5 times measurement are shown in Table 5 below.

As is clear from Table 5, the golf ball of each of Examples is excellent in both terms of a resilience performance and a feel at impact. Accordingly, advantages of the present invention are clearly indicated by these results of evaluation.

The description herein above is merely for illustrative examples, and therefore, various modifications can be made without departing from the principles of the present invention.

What is claimed is:

1. A golf ball which comprises a core, a cover having Shore D hardness of equal to or greater than 58, and numerous dimples formed on the surface of said cover, wherein a proportion R1 of the number of dimples having a ratio (B/T), which is a ratio of a height B of a bottom of the dimple to a nominal thickness T of the cover, of equal to or less than 0.80 occupied in total number of the dimples is equal to or greater than 10%, and a proportion R2 of the number of dimples having said ratio (B/T) of less than 0.40 occupied in total number of the dimples is equal to or less than 10%.

2. The golf ball according to claim 1 wherein a mean value of the ratio (B/T) for all the dimples is equal to or less than 0.86.

3. The golf ball according to claim 1 wherein said core comprises a center and a mid layer, and when the Shore D hardness of the mid layer is referred to as Hm and Shore D hardness of the cover is referred to as Hc, the value (Hc-Hm) is equal to or greater than 3.

4. The golf ball according to claim 3 wherein Shore D hardness of the mid layer is equal to or less than 60.

* * * * *